United States Patent [19]

Huff

[11] Patent Number: 5,014,850

[45] Date of Patent: May 14, 1991

[54] UTILITIES STORAGE BOX

[76] Inventor: Phyllis M. Huff, 809 Yenowine La., Georgetown, Ind. 47122

[21] Appl. No.: 516,319

[22] Filed: Apr. 30, 1990

[51] Int. Cl.[5] ..... B65D 85/28; B05C 17/00

[52] U.S. Cl. ..... 206/371; 206/575; 206/561; 206/1.7; 206/818

[58] Field of Search ..... 206/575, 371, 1.7, 561

[56] References Cited

U.S. PATENT DOCUMENTS

| | | | |
|---|---|---|---|
| 239,274 | 3/1881 | Schadowsky | 206/371 X |
| 1,086,735 | 2/1914 | Spaulding | 206/1.7 X |
| 1,217,283 | 2/1917 | Daniel et al. | 206/371 X |
| 3,861,556 | 1/1975 | Barecki et al. | 206/371 X |
| 4,129,213 | 12/1978 | Fleig | 206/575 |
| 4,475,650 | 10/1984 | De Fazio, Jr. | 206/371 |
| 4,693,371 | 9/1987 | Malpass | 206/561 |

FOREIGN PATENT DOCUMENTS

| | | | |
|---|---|---|---|
| 2819618 | 3/1979 | Fed. Rep. of Germany | 206/371 |

*Primary Examiner*—William I. Price

*Attorney, Agent, or Firm*—Edward M. Steutermann

[57] ABSTRACT

A utility storage box particularly useful for storage items such as drawing instruments and school supplies including a base enclosure having a generally planar bottom with laterally upstanding side walls, a lid member hinged along one wall with an upstanding wall located within the base defining a compartment therein. The lid has a recessed segment with a peripheral configuration generally approximating the peripheral configuration of the compartment defined within the base. A raised section can be provided in the lid to overlie a section of the base outside the compartment so that utensils of differing mean diameter can be located in the base to be contacted by the raised/lowered segments to hold the utensils in position. Guide strips can be provided within the compartment to orient drawing or other utensils within the compartment. Latches can be provided on the lid along a side other than the hinged side to retain the lid in closed position, and a lock hasp can be provided to allow the unit to be locked. A handle can be provided.

3 Claims, 1 Drawing Sheet

UTILITIES STORAGE BOX

BACKGROUND OF THE INVENTION

The present invention relates, in general, to utility retaining devices and more particularly relates to utility retaining devices which are useful for retaining pencils, crayons, markers, and other utensils used in connection with educational programs. While the devices within the scope of the present invention are described with regard to this purpose, it will be understood that devices within the scope of the present invention have a wide variety of uses and can be adapted to satisfy many specific needs.

In general, in connection with education it is frequently desirable and often necessary for students to maintain drawing or other markings utensils such as crayons, markers, pencils, etc. for ready access. Additionally, it is desirable that the devices utilized to retain such markers or other utensils should not damage the utensils. It is even more desirable that the means used to retain the devices should hold the devices firmly to prevent damage.

Prior art arrangements are known which are intended to accomplish similar purposes but none accomplishes the objectives or the purposes of the present invention satisfactorily. U.S. Pat. No. 239,274 illustrates a box intended for holding lead pencils where separate compartments are provided for each pencil. The device is intended for lead pencils and does not have the flexibility or the compartments provided by devices within the scope of the present invention.

U.S. Pat. No. 4,129,213 teaches a portable craft and hobby kit provided with a lid where a foam material is provided to hold down the devices within the box, contrary to arrangements within the scope of the present invention where recesses and raised sections are provided in the lid.

U.S. Pat. No. 1,217,283 like reference no. U.S. Pat. No. 239,274, teaches a box having clearly defined receptacles for specific items such as pencils.

U.S. Pat. No. 3,861,556 teaches an arrangement where a box is provided which is substantially different from devices within the scope of the present invention.

In summary, no known prior art arrangement teaches or even remotely suggests utensil retaining devices having the features of devices within the scope of the present invention.

SUMMARY OF THE INVENTION

As previously stated, the present invention relates to storage devices and more particularly relates to storage device which are particularly useful in storing small items such as pens, pencils, marker, glue and other items such as scissors. While examples of arrangments within the scope of the present invention are discussed with respect to such features it will be understood that devices within the scope of the present invention can be designed to be useful for other applications.

More particularly, the present invention provides a new, useful, and and inexpensive holder device which can be easily molded of suitable materials in order to minimize cost and which can be utilized by school children.

One of the problems typically encountered in connection with storage of student utensils is that if the enclosure is dropped the lid opens so the contents are spilled, and frequently damaged. Within the scope of the present invention means are provided to easily latch and unlatch the device to allow easy access to the contents of the device but to maintain the device in a closed condition to prevent spilling the contents in the event the device is dropped.

Devices within the scope of the present invention can also be provided with a hasp arrangement to allow the device to be locked.

One salient feature of devices within the scope of the present invention is that there is an internal compartment defined within a base enclosure with a lid with a recessed portion which engages the top of the compartment to securely retain items within the compartment. Such an arrangement is particularly useful when utilized with friable utensils, such as crayons. A second portion of the lid can be raised to allow storage of larger items in an adjacent section of the unit. Additionally, a handle can be provided for carrying the device and the recessed portion can extend through to the top so that the device can be closed and the recessed portion in the top used to retain items in storage.

More particularly, the present invention provides a utility storage box particularly useful for storage of drawing instruments and school supplies including a base enclosure having a generally planar bottom with laterally upstanding side walls, a lid member hinged along one wall with, an upstanding wall located within the base defining a compartment therein. The lid has a recessed segment having a peripherial configuration generally approximating the peripherial configuration of the compartment defined within the base. A raised section can be provided in the lid to overlie a section of the base outside the compartment so that utensils of differing mean diameter can be located in the base to be contacted by the raised/lowered segments to hold the utensils in position. Guide strips can be provided within the compartment to orient drawing or other utensils within the compartment. Latches can be provided on the lid along a side other than the hinged side to retain the lid in closed position, and a lock hasp can be provided to allow the unit to be locked. A handle can be provided.

An example of an arrangement within the scope of the present invention is illustrated in the accompanying drawings and described hereinafter but it will be understood that other arrangements also within the scope of the present invention, will occur to those skilled in the art upon reading the disclosure set forth hereinafter.

BRIEF DESCRIPTION OF THE DRAWINGS

In connection with the example of the present invention shown in the drawings and discussed hereinafter.

DETAILED DESCRIPTION OF THE DRAWINGS

Figures 1, 2, 3, 4:
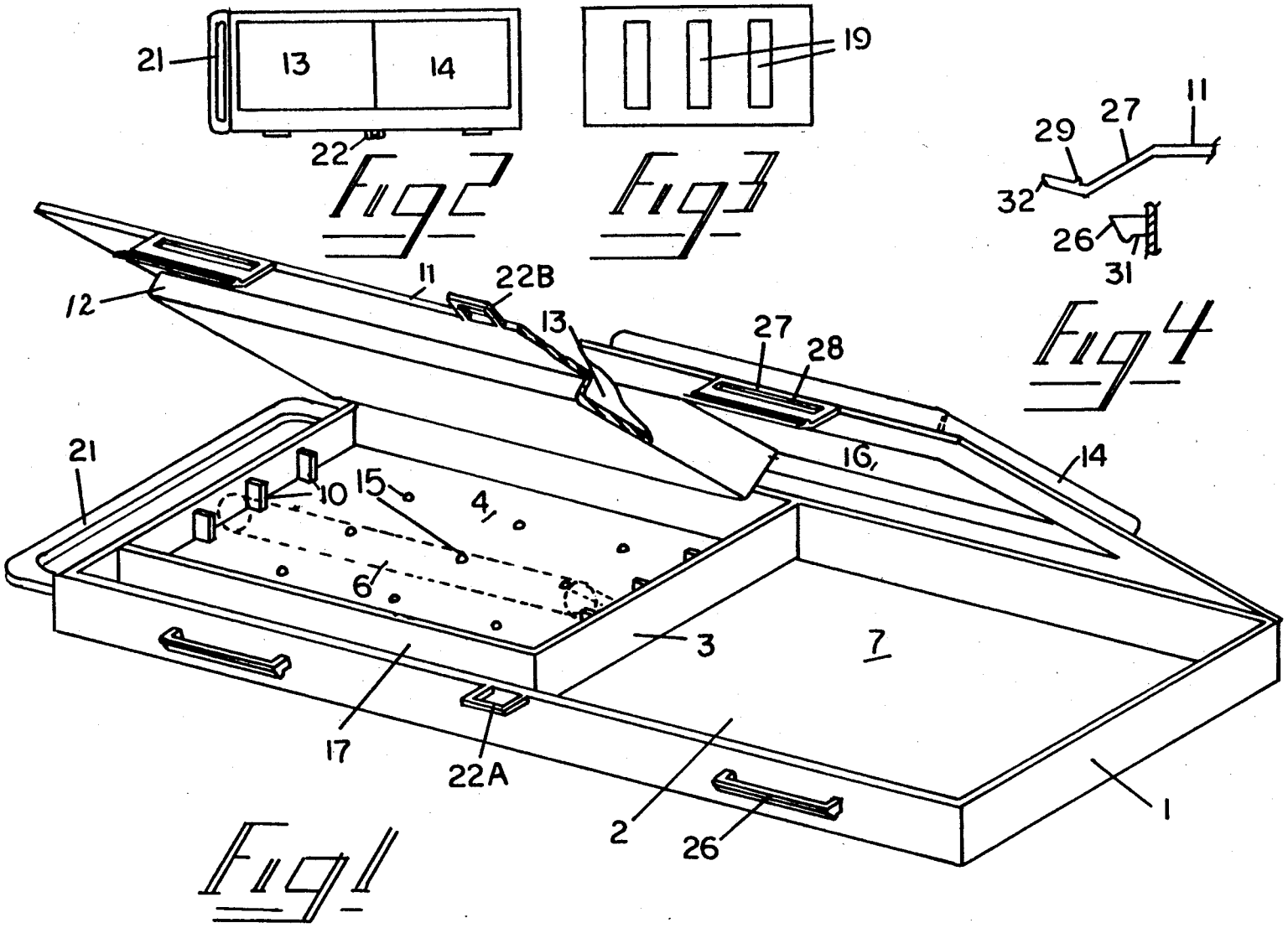
FIG. 1 is a perspective, partially in cross section, view of an arrangement within the scope of the present invention.
FIG. 2 is a top plan view of the arrangement shown in FIG. 1.
FIG. 3 is a bottom plan view of the example of an arrangement within the scope of the present invention shown in FIG. 1.
FIG. 4 is a segmental end view of the latch system utilized in the arrangement shown in FIG. 1.

Referring now to FIG. 1 which illustrates one example of an arrangement within the scope of the present invention a base enclosure 1 is provided having a generally planar bottom 2 with upstanding walls therearound.

An internal wall 3 is provided defining a compartment 4 which can be utilized for various purposes such as the retention of crayons or drawing instruments shown in dotted line 6.

In the arrangement shown a space 17 is defined between the upstanding walls of the base and the compartment wall 3 and second compartment 7 is also defined within the base.

As shown a lid 11 is provided to close the opening defined by the upstanding walls of base 1. In accordance with one feature of the present invention a recessed segment 12 is provided having a peripheral configuration generally similar to the peripheral configuration of the compartment 4 so that the recessed portion 12 of the lid 11 is received within the compartment 4 to retain the crayon 6 or other instruments contained within the compartment to restrict movement and prevent damage.

As shown, the recessed segment 12 defines an area 13 which can be utilized to hold the drawing instruments retained in the compartment 4 when the instruments are in use.

Conversely a raised section 14 is provided in the lid 11 defining an internal chamber 16 which is located above the chamber 7 so that items having a larger size can also be accommodated by the device and retained therein.

The location of the segments 13 and 14 is illustrated in FIG. 2.

As shown in FIG. 3 the base 2 can be provided with recesses 19 adapted to receive magnets so that the device can be located on a metallic surface and will hold because of the magnetic force.

As shown in the Figures a handle assembly 21 can be provided at one end of the device but can also be provided elsewhere if desired.

Cooperative hasp members 22A, 22B, are provided to form a cooperative lock hasp 22 which can be utilized to lock the unit when desired.

As also shown separators 10 can be provided within the area 4 to locate the crayons 6 and retain them in selected orientation. For location of devices crosswise in the compartment 4 dimples 15 can be provided to restrict lateral movement of generally tubular elements retained in the device. Between the spacers 10 and the dimples 15 shorter or longer instruments can be sucessfully retained within the device.

As also shown latches 27 can be provided to be secured to catches 26 which are located on the upstanding walls of the compartment of the base 1. FIG. 4, is a cross sectional view illustrating the features of the closure assembly. In the closure assembly the element 27 is provided, and as shown in FIG. 1, has an opening 28 which is adapted to receive the bar 26 also shown in FIG. 1. In the arrangement shown the element 27 is pivotable on the lid 11 where the bar 26 is received in the opening 28. A detent 29 is received in a groove 31 within the element 26 to hold the latch shut. A lever assembly 32 is provided to retain the detent 29 and also to provide a release of the element 27 from the element 26 for opening the lid.

It will be understood that the foregoing is but one example of an arrangement within the scope of the present invention and that various other arrangements also within the scope of the present invention will occur to those skilled in the art upon reading the disclosure set forth hereinbefore.

The invention claimed is:

1. A utility storage box useful for storage of selected items including: base enclosure means having a generally planar bottom with laterally upstanding side walls; lid means hinged along one side wall; upstanding dividing wall means located within the base defining a compartment therein; recess segment located within said lid means having a peripheral configuration generally approximating the peripherial configuration of said compartment defined within said base enclosure means; raised section in said lid to overly a section of said base enclosure outside said compartment so that selected items of differing mean diameter can be located in said base enclosure to be selectively contacted by said recessed and raised segments to hold said selected items in position.

2. The invention of claim 1 including guide strips located within said compartment to orient said selected items within said compartment.

3. The invention of claim 1 including latch means located on said lid along a side other than the hinged side to retain said lid in closed position.

* * * * *